US007185634B2

(12) United States Patent
Gardner et al.

(10) Patent No.: US 7,185,634 B2
(45) Date of Patent: Mar. 6, 2007

(54) HIGH EFFICIENCY, HIGH PRESSURE FIXED DISPLACEMENT PUMP SYSTEMS AND METHODS

(75) Inventors: Jeffrey T. Gardner, Woodland Park, CO (US); Guy Robert Babbitt, Colorado Springs, CO (US); Jeffrey A. Rogers, Woodland Park, CO (US); Gary Mansouri, Bothell, WA (US); Jonathan J. Lorenzen, Colorado Springs, CO (US); Oded Eddie Sturman, Woodland Park, CO (US)

(73) Assignee: Sturman Industries, Inc., Woodland Park, CO (US)

( * ) Notice: Subject to any disclaimer, the term of this patent is extended or adjusted under 35 U.S.C. 154(b) by 0 days.

(21) Appl. No.: 11/088,582

(22) Filed: Mar. 24, 2005

(65) Prior Publication Data

US 2006/0027212 A1 Feb. 9, 2006

Related U.S. Application Data

(60) Provisional application No. 60/556,276, filed on Mar. 25, 2004.

(51) Int. Cl.
*F02M 37/04* (2006.01)

(52) U.S. Cl. ..... 123/446; 123/467

(58) Field of Classification Search ..... 123/467, 123/446, 447, 458, 357, 90.12
See application file for complete search history.

(56) References Cited

U.S. PATENT DOCUMENTS 5,191,867 A * 3/1993 Glassey ..... 123/446
5,357,912 A * 10/1994 Barnes et al. ..... 123/357
5,460,329 A 10/1995 Sturman
5,485,820 A * 1/1996 Iwaszkiewicz ..... 123/458
5,957,111 A * 9/1999 Rodier ..... 123/458
6,349,702 B1 * 2/2002 Nishiyama ..... 123/456
6,371,077 B1 * 4/2002 McGee ..... 123/299
6,484,696 B2 * 11/2002 Barnes et al. ..... 123/446
6,609,500 B2 * 8/2003 Ricco et al. ..... 123/446
6,739,293 B2 5/2004 Turner et al.
6,792,915 B2 * 9/2004 Rembold et al. ..... 123/446

(Continued)

OTHER PUBLICATIONS

Mansouri, Ali Reza, "Adaptive Switched-Mode Control of a Hydraulic Pump", Thesis Submitted to University of Colorado, Spring 2000, pp. 1-49.

*Primary Examiner*—Carl S. Miller
(74) *Attorney, Agent, or Firm*—Blakely Sokoloff Taylor & Zafman LLP

(57) ABSTRACT

High efficiency, high pressure fixed displacement pump systems and methods of control. A typical application is for engine driven high pressure pumps for powering loads such as fuel injectors and/or hydraulic engine valve actuators. The pump systems include a control valve controllably coupling the pump output back to the pump input to stop the pumping when the desired pressure of the output is reached. Reinitiating pumping an increment in crankshaft angle before a load event based in the increment in pressure needed to reach the desired pressure at the crankshaft angle of the load event provides a simple control algorithm assuring accurate repeatability in the pressure at the beginning of a load event. Pumping throughout the load event minimizes the decrease in pressure during the load event. Providing underlap in the control valve minimizes pressure peaks and maximizes efficiently when starting and stopping the pumping action. Various embodiments are disclosed.

17 Claims, 11 Drawing Sheets

U.S. PATENT DOCUMENTS 6,889,656 B1 * 5/2005 Rembold et al. ..... 123/466
2003/0015155 A1 1/2003 Turner et al.
2003/0213445 A1 * 11/2003 Bloms et al. ..... 123/90.12
2004/0099247 A1 * 5/2004 Nelson ..... 123/446

* cited by examiner

HIGH EFFICIENCY, HIGH PRESSURE FIXED DISPLACEMENT PUMP SYSTEMS AND METHODS

CROSS-REFERENCE TO RELATED APPLICATION

This application claims the benefit of U.S. Provisional Patent Application No. 60/556,276 filed Mar. 25, 2004.

BACKGROUND OF THE INVENTION

1. Field of the Invention

The present invention relates to the field of pumps.

2. Prior Art

For the purposes of specificity in the description of exemplary embodiments to follow, such embodiments will be described with respect to the application of the present invention to internal combustion engines, such as gasoline engines and diesel engines, though the use of the present invention is not so limited. By way of one example, intensifier type diesel engine fuel injectors are well known in the prior art, such as that shown in U.S. Pat. No. 5,460,329, the disclosure of which is incorporated herein by reference. That fuel injector is a hydraulically actuated, intensifier type fuel injector controlled by an electrically actuated double solenoid spool valve that magnetically latches by residual magnetism. However, it is to be noted that other fuel injector designs and types and other types of control valves may also be used, such as similar spool valves which do not latch, such as by way of example, single coil spring return spool valves, as are also well known in the art.

As another example, hydraulically actuated engine intake and exhaust valve systems are also known in the prior art, such as described in U.S. Patent Application Publication No. U.S. 2003/0015155A1, the disclosure of which is also incorporated herein by reference. That application discloses various embodiments of hydraulic engine valve actuation systems, subsequently referred to herein as HVA systems. The HVA systems of the foregoing application utilize a two-stage control, namely, one or more small electrically operable control valves to hydraulically control a typically larger second stage valve for controlling the flow of high pressure actuation fluid to and from the engine valve actuator. Hydraulic fluid, typically engine oil, is provided in such systems from both a low pressure rail and a high pressure rail, the low pressure rail being used by the control valve to control the position of the second stage valve, the second stage valve controlling the flow of hydraulic fluid, again typically engine oil, from a high pressure rail to the engine valve actuator in both spring return and hydraulic return engine valve actuator systems.

A typical hydraulically actuated intensifier type fuel injector, however, normally operates from a single high pressure rail, the phrase "high pressure," of course, being relative in that the pressure typically is a high pressure for the actuating fluid for the intensifier of the fuel injector, though the fuel pressure is intensified for injection to a pressure a number of times higher than the high pressure of the actuating fluid. In the case of fuel injection, the hydraulic energy used is significant, while in HVA systems the hydraulic energy used is particularly significant. Accordingly, efficiency of the high pressure pump is an important consideration in either case, and particularly in engines using both.

Pumps generally displace a volume of fluid proportional to the angle through which their input shaft is turned. This results in a proportional relationship between the volumetric flow rate (displaced volume per unit time) from the pump and the speed at which the pump input shaft is turned. Since the load flow that the pump is replacing is usually not related to the pump input shaft angle, but varies independently with time, a time base is the most reasonable base in which to create a pump control algorithm. Therefore, this is usually what is done.

DETAILED DESCRIPTION OF THE PREFERRED EMBODIMENTS

Figure 1:
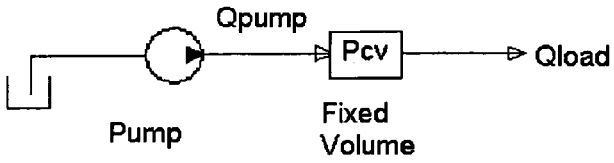
FIG. 1 is a diagram of a digital pump system in accordance with the present invention.

Certain engine mounted pump applications present a unique opportunity to reevaluate the prior art approach to pump control. Using an engine mounted pump to supply oil to a hydraulically actuated engine or gas exchange valve system or hydraulically driven injectors are examples of this type of application. The oil consumed by either of these systems is strongly related to engine crankshaft angle. As an example, there may be a fixed number of injection events per engine crankshaft revolution, and if the volume of hydraulic fluid consumed for each injection event is fixed, then the volume of oil consumed per engine crankshaft revolution is also fixed. So for this application, the load is crankshaft angle dependent rather than time dependent. As was already discussed, the volume of oil supplied by the pump is proportional to the angular displacement of the pump input shaft. If the pump is mechanically driven from the engine, the volume of oil supplied by the pump is also crankshaft angle dependent, rather than time dependent. Utilizing this fact and developing the control algorithm in the crankshaft angle domain has significant advantages over the traditional time domain approach. The primary benefit of using a crankshaft angle base is that the result is largely independent of engine speed.

The crankshaft angle based pump control algorithm has additional benefits when used with what is referred to herein as a digital pump. A digital pump allows a fixed displacement pump to produce a varied average flow from the pump similar to a more complicated variable geometry pump. The digital pump accomplishes variable average flow by controllably redirecting the pump flow back to the pump inlet for a certain percentage of the engine rotation. This "on-off" pump switching can occur at a high frequency and produce a controllable average flow from the pump. In applications where the hydraulic load is not continuous, but discrete and predictable, as a hydraulically driven injector or a hydraulically actuated engine intake or exhaust valve, in accordance with a preferred embodiment of the present invention, the pump switching is synchronized to the load. This creates a more uniform pressure supply from hydraulic load event to hydraulic load event with a lower switching frequency and less required hydraulic capacitance (storage).

A drawback to synchronizing the pump switching to the load is that there is a switching frequency dependant stability limit for the pump controller. This stability limitation is very similar to the stability limitation for digitally sampled continuous systems where the system crossover frequency is generally kept below one quarter of the sample frequency in order to maintain stability. Since the load frequency is variable with engine speed in the time domain, the stability limit and thus the optimal system crossover frequency are also speed dependent if the controller is designed in the time domain. This complication is avoided if the control design is done in the angle domain instead as in a preferred embodiment of the present invention.

System dynamics in the angle domain are very similar to the system dynamics in the time domain. Consider a very general system where the flow from a pump $Q_{pump}$ is modulated to control the pressure in a fixed volume where an uncontrolled flow leaves the volume, as illustrated in FIG. 1. In the time domain, the differential equation governing the pressure in the control volume is:

$$\frac{dP_{cv}}{dt} = \frac{\beta}{Vol}(Q_{pump} - Q_{load})$$

where:

$P_{cv}$=the pressure in the fixed volume Vol t=time

β=the bulk modulus of the fluid $Q_{pump}$ and $Q_{load}$=pump and load flow rates into and out of the fixed volume, respectively $$Q_{pump} = \frac{dVol_{in}}{dt} \text{ and } Q_{load} = \frac{dVol_{out}}{dt},$$

the differential equation for pressure becomes:

$$\frac{dP_{cv}}{dt} = \frac{\beta}{Vol}\left(\frac{dVol_{in}}{dt} - \frac{dVol_{out}}{dt}\right).$$

The control variable is $$\frac{dVol_{in}}{dt}$$

and the controlled variable is $P_{cv}$. The control variable $$\frac{dVol_{in}}{dt}$$

is varied by adjusting the length of time t that the pump is on between load events.

If both sides of the time domain equation for $$\frac{dP_{cv}}{dt}$$

are divided by speed $$\left(\frac{dca}{dt}\right)$$

(where ca is the crankshaft angle), the differential equation-governing the pressure in the control volume in the crankshaft angle domain results:

$$\frac{dP_{cv}}{dca} = \frac{\beta}{Vol}\left(\frac{dVol_{in}}{dca} - \frac{dVol_{out}}{dca}\right)$$

The control variable is now $$\frac{dVol_{in}}{dca}$$

and the controlled variable is still $P_{cv}$. The control variable $$\frac{dVol_{in}}{dca}$$

is now varied by adjusting the angle over which the pump is pumping into the fixed volume between load events. Since the load events are generally evenly spaced in crankshaft angle irrespective of speed, the control variable generally does not need to change to compensate for changes in speed. In addition, since the sample period is tied to the load events and therefore constant in crankshaft angle degrees, the controller design relative to the sampling stability limit is optimal at all speeds. Conveniently, the equation for pressure in the crankshaft angle domain is identical to the equation in the time domain, but with crankshaft angle (ca) replacing time (t) as the independent variable. Because of this, the form of the control law developed for the system in the time domain is also applicable in the angle domain. The crankshaft angle based controller is designed using the same techniques as a traditional time based controller for a sampled data system with crankshaft angle substituted for time as the independent variable. In a simple form, the pressure in the fixed volume is measured before a load event, and the crankshaft angle of rotation for active pumping required to bring the pressure in the fixed volume up to the target pressure for the beginning of the load event is determined. Then at that angular increment before the load event, the pump is activated, attaining the target pressure in the fixed volume just as the load event begins. This also allows pumping throughout all or a fixed part of the load event, reducing the storage requirements of the fixed volume and maintaining a more predictable pressure or pressure variation throughout the load event than if the pump was simply reacting to pressure in the fixed volume in the time domain, and was sometimes on and sometimes off during a load event.

Figure 2A:
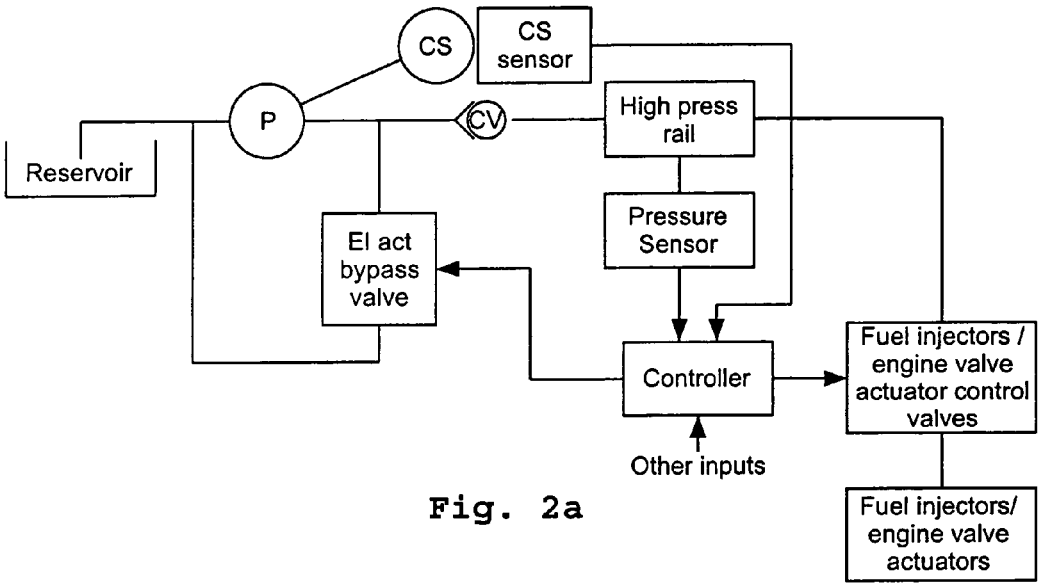
FIG. 2*a* is a diagram of an embodiment of the present invention using a check valve.

Now referring to FIG. 2*a*, an embodiment of the present invention may be seen. A reservoir of hydraulic fluid, typically but not necessarily engine oil, is provided to supply hydraulic fluid to the high pressure pump P driven directly or indirectly from the engine crankshaft CS. The pump P pumps the hydraulic fluid through the check valve CV to the high pressure rail used to supply actuation fluid to fuel injectors or engine valve actuator control valves, or both, and/or for other purposes, as controlled by a controller controlling the actuator control valves to operate the fuel injectors or engine valve actuators, or both. Such controllers respond not only to crankshaft angle, but also to various other inputs, such as power setting, engine operating conditions and environmental conditions.

The pressure in the high pressure rail is sensed by a pressure sensor, with the controller controlling an electrically actuated bypass valve to controllably bypass the output side of the high pressure pump P to the inlet of the pump or to the reservoir. This allows the use of a fixed displacement pump P, such as a relatively low cost gear-type pump, while at the same time avoiding energy loss through a pressure regulator when the flow rate of the high pressure fluid provided by the pump P exceeds the demand for high pressure hydraulic fluid from the high pressure rail. The check valve CV, of course, prevents backflow from the high pressure rail when the electrically actuated bypass valve is opened.

One aspect of the embodiment of FIG. 2*a* is the coupling of a crankshaft (CS) sensor, typically a crankshaft angle sensor or a sensor from which crankshaft angle may be determined, to the controller, not only for control of the fuel injectors and/or engine valve actuator control valves, but also for control of the electrically actuated bypass valve. This allows operation of the system as schematically illustrated in FIG. 6*a* or FIG. 6*b*.

Figure 2B:
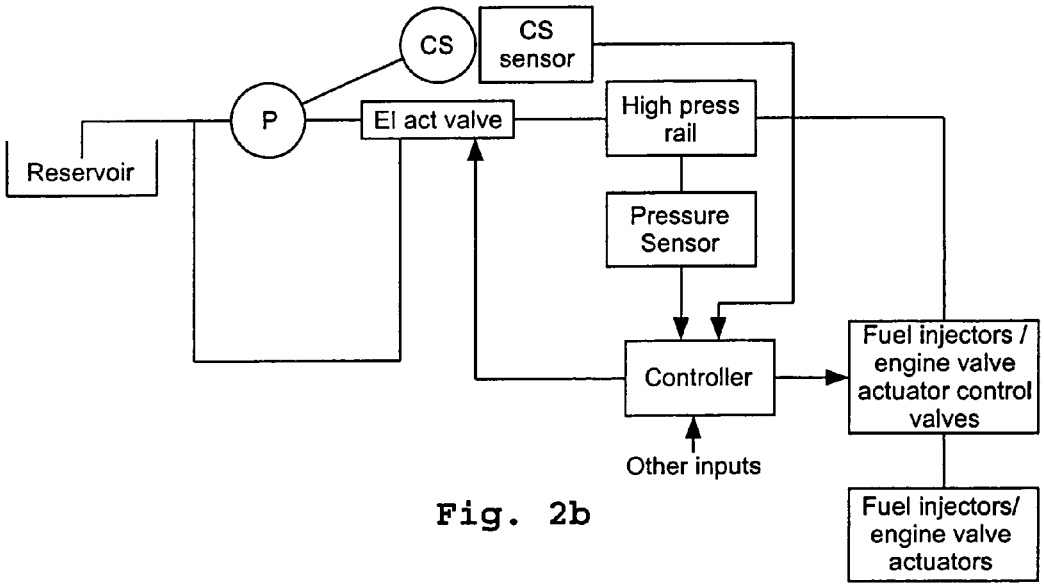
FIG. 2*b* is a diagram of an embodiment of the present invention using a three-way valve.

FIG. 2*b* shows an alternate embodiment, namely one using a single electrically actuated valve for directing flow to the high pressure rail or to the pump P inlet rather than a check valve and a bypass valve. While a check valve is low cost and self timing, so to speak, it may not have the desired reliability in high pressure, high frequency applications, or be fast enough for high engine operating speeds.

Figure 6:
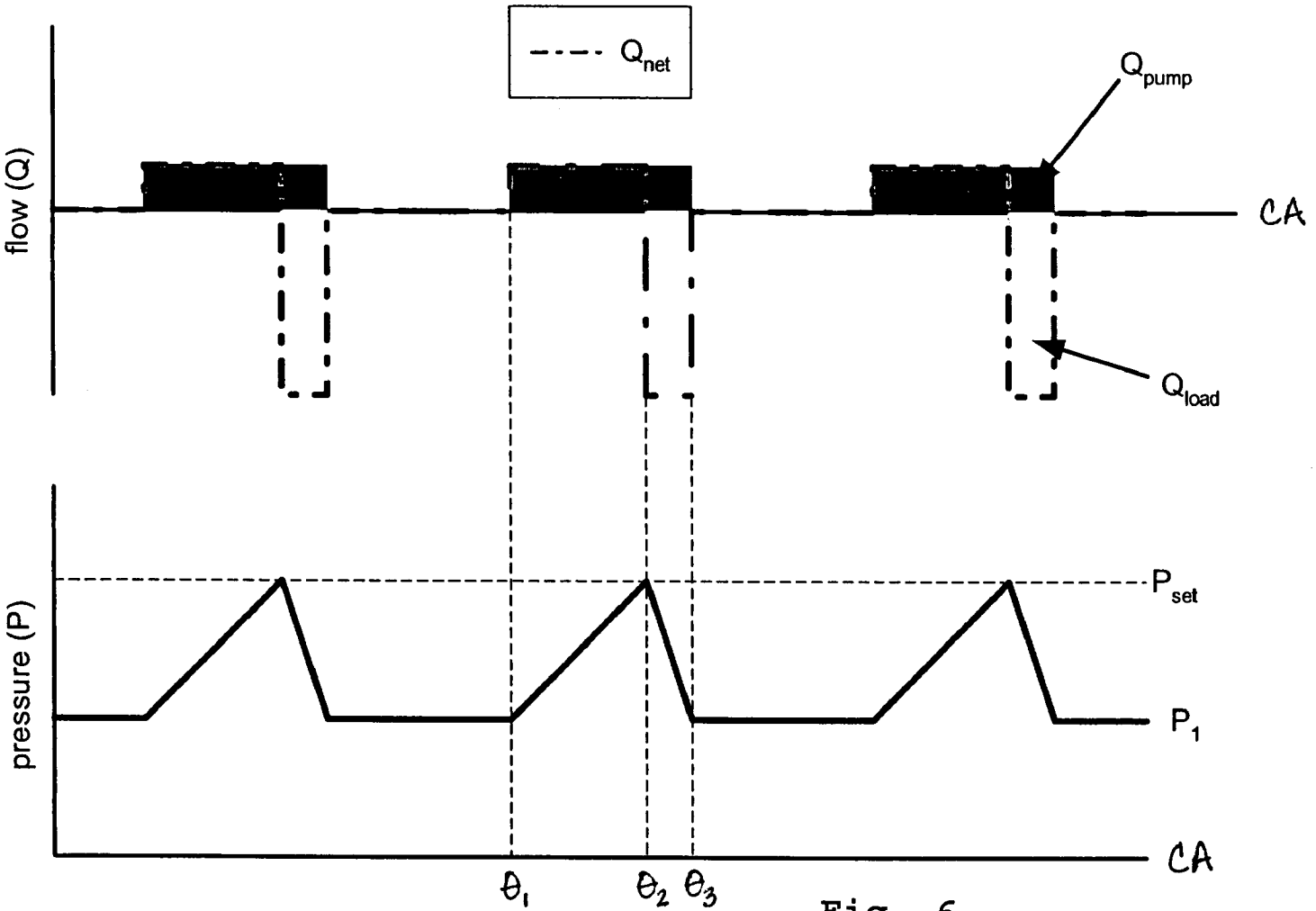
FIG. 6 illustrates the operation of a pumping system in accordance with the present invention.

FIG. 6 presents a graph illustrating rail pressure versus crankshaft angle and pump state versus crankshaft angle around the period of a load event (fuel injector and/or engine valve actuation) in accordance with the operation of the system of FIG. 2*a*. The crankshaft angle at which a particular load event may occur can change with engine operating conditions and/or environmental conditions, one of the advantages of such electronically controlled systems. In FIG. 6, it will be noted that while the load event is occurring between crankshaft angles $\theta_2$ and $\theta_3$, the pressure between load events may be lower than the desired rail pressure at the beginning of a load event, and in fact may be significantly lower than the desired rail pressure at the beginning of a load event. This allows closing the electrically activated bypass valve by the controller at a crankshaft angle $\theta_1$ (see FIG. 2*a*) in anticipation of the occurrence of the load event, which itself is controlled by the controller. This causes the rail pressure to increase to the desired rail pressure at the initiation of the load event at angle $\theta_2$, so that the high pressure pump P usually will be pumping to the high pressure rail throughout the load event, and could, if desired, pump for some period after the load event until the desired pressure between load events (P1) is reached in readiness for anticipation of the next load event. Thus when the pressure P1 between load events is reached, the electrically activated bypass valve would bypass the high pressure pump outlet to the pump inlet.

In that regard, because the pump P is preferably a fixed displacement pump, the crankshaft angle for closing the electrically activated bypass valve will nominally correspond to a predetermined crankshaft angle increment before the crankshaft angle the controller chooses for the initiation of the load event, though may vary somewhat with crankshaft angular velocity because of delays, particularly in the operation of the electrically actuated bypass valve, and perhaps dependent on one or more other engine operating conditions and/or environmental conditions as well as pump wear, etc., which may effect pump efficiency. However the controller may easily be made self adaptive, in that it may make load event to load event crankshaft angle corrections in the operation of the bypass valve based on measurements of rail pressure at the initiation of a prior load event, thereby closing the loop to accurately control the rail pressure at the beginning of a subsequent load event, in spite of longer term changes that otherwise would effect the rail pressure at the beginning of a load event.

While the pump P is preferably a fixed displacement pump, the slope of pressure versus crankshaft angle between angles $\theta_1$ and $\theta_2$ will be $\beta Q_{net}/vOl$, where $\beta$ is the bulk modulus of the hydraulic fluid in the rail, vol is the rail volume and $Q_{net}$ is the net pump flow into the rail. The advantage, however, in starting from a lower pressure and then pumping to reach the desired rail pressure simultaneously with the initiation of the load event is that the electrically actuated bypass valve is closed and stable and the pump is operating at its full capacity at the beginning of the load event to help sustain the rail pressure throughout the load event to the maximum extent possible. In that regard, if the electrically actuated bypass valve was operated directly from the pressure sensor signal, hysteresis and delays could effectively keep the high pressure pump from pumping to the high pressure rail throughout most, if not all, of the load event. While the pump P may have a pumping rate that is less than the demand for high pressure fluid during a load event, it is still advantageous to have the pump pumping to the high pressure rail during the load event to reduce the drop-off in pressure as much as possible.

In the present invention method of operation, the controller may sense the pressure of the high pressure rail at the beginning of each load event and make adjustments in the crankshaft angle to initiate the pump before the next corresponding load event so that the desired rail pressure is reached quite accurately, load event to load event, by that look ahead feature. Further, it may be desired to reduce the desired rail pressure between load events. By way of example, the rail pressure required to open an exhaust valve on a diesel engine when there has been a power setting change may increase or decrease, depending on the change in the power setting, which of course may be readily accomplished by adjusting the crankshaft angle for initiating pumping, the quiescent pressure between load events, or both. Finally, the desired rail pressure possibly could be different within a reasonable range between the desired pressure for the fuel injectors and the desired pressure for the HVA system, all of which the controller could control and still anticipate each desired rail pressure before the corresponding load event. Operation of the system of FIG. 2*b* is substantially the same.

In FIG. 6, the pump flow to the high pressure rail is stopped at the end of the load event and crankshaft angle $O_3$. Consequently, a separate control signal at a subsequent crankshaft angle is not needed and pump flow may be again directed to the high pressure rail as soon as needed to achieve the desired rail pressure at the crankshaft angle of initiation of the next load event. This also allows the largest achievable change (reduction) in the rail pressure from one load event to the next load event, short of the stopping pumping before the end of a load event.

Figure 7:
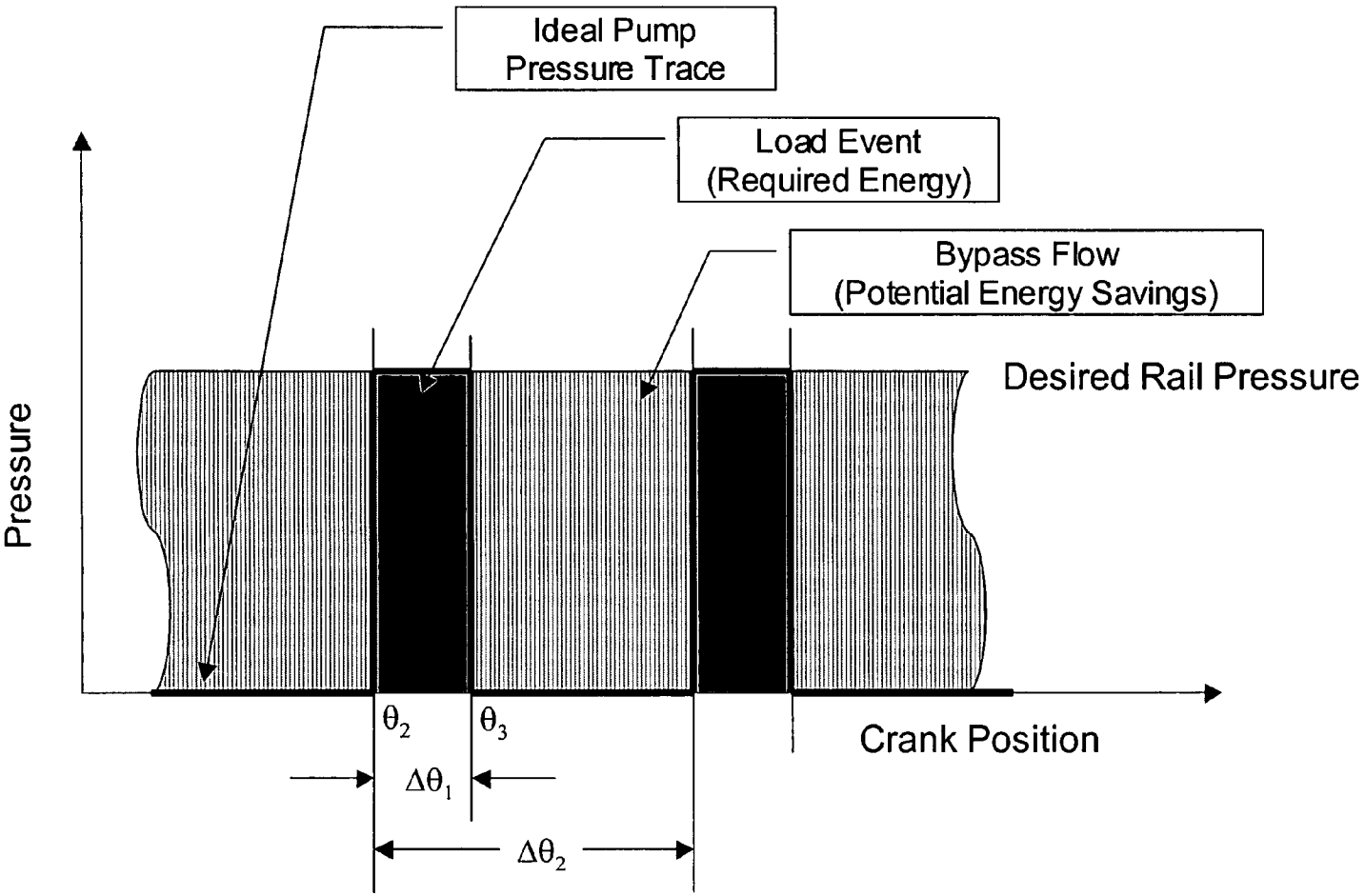
FIG. 7 is an illustration of the energy savings by the present invention method of pumping system operation in an ideal case.

FIG. 7 is an illustration of the energy savings by the present invention method of pumping system operation in an ideal case. In particular, in this illustration it is assumed that the fixed displacement pump has a flow rate exactly equal to the demand for high pressure hydraulic fluid during each load event, that the electrically actuated control valves respond immediately at the end of each load event to immediately vent the high pressure pump to the low pressure reservoir and that there are no fluid flow or compressibility losses. Assuming that in each crankshaft angle $\Delta\theta_2$, each load event lasts for a crankshaft angle $\Delta\theta_1$, then in comparison to an equivalent system that merely discharges the excess high pressure flow to the reservoir through a pressure regulator, the total power required by the pump is reduced by the fraction $\Delta\theta_1/\Delta\theta_2$.

Figure 8:
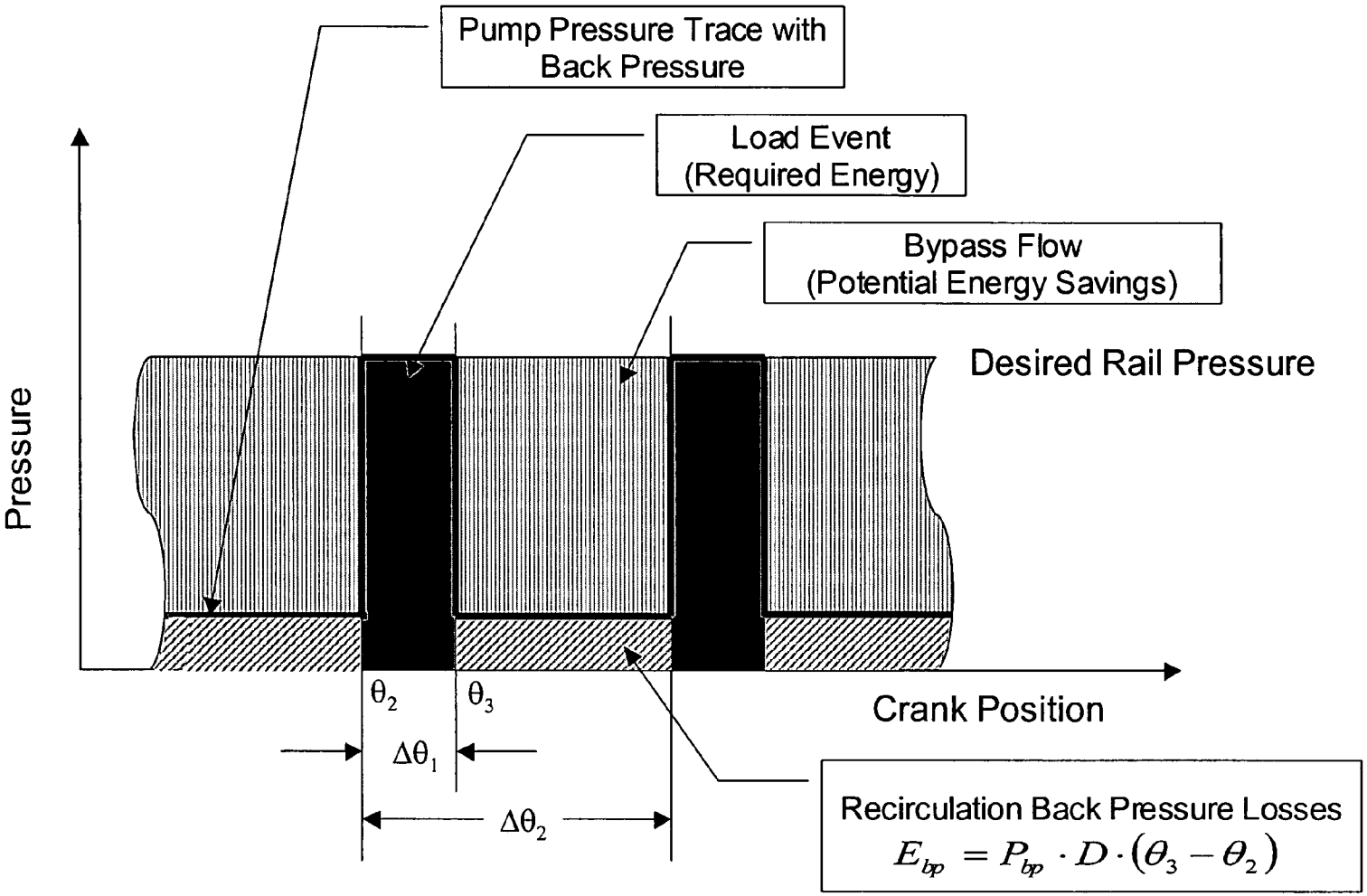
FIG. 8 illustrates the pumping losses that would be incurred by dumping the excess high pressure fluid through a regulator to the reservoir, or just flow losses.
Figure 9:
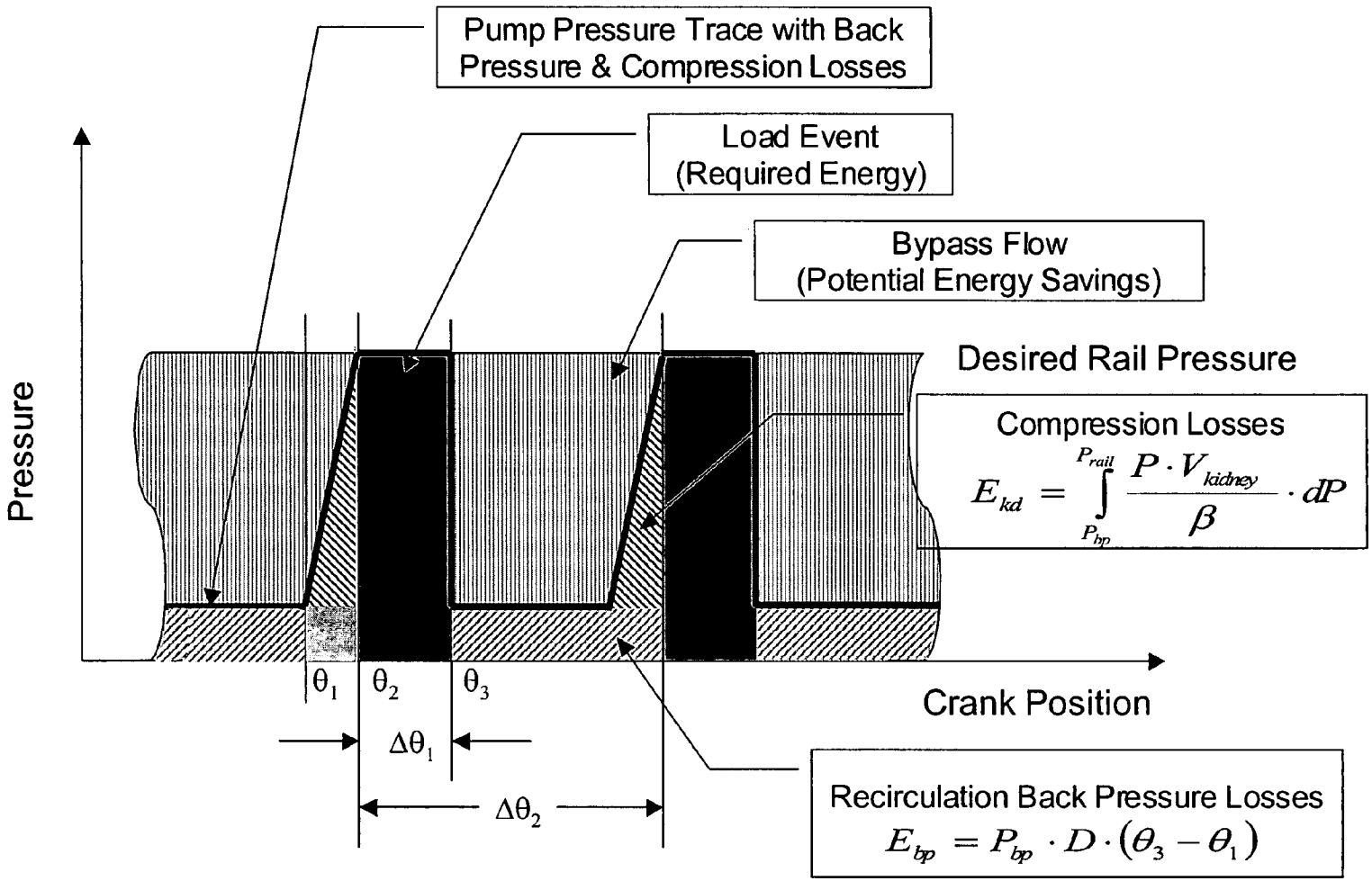
FIG. 9 illustrates the pumping energy absorbed in the compression of the hydraulic fluid in the output side of the pump.
Figure 10:
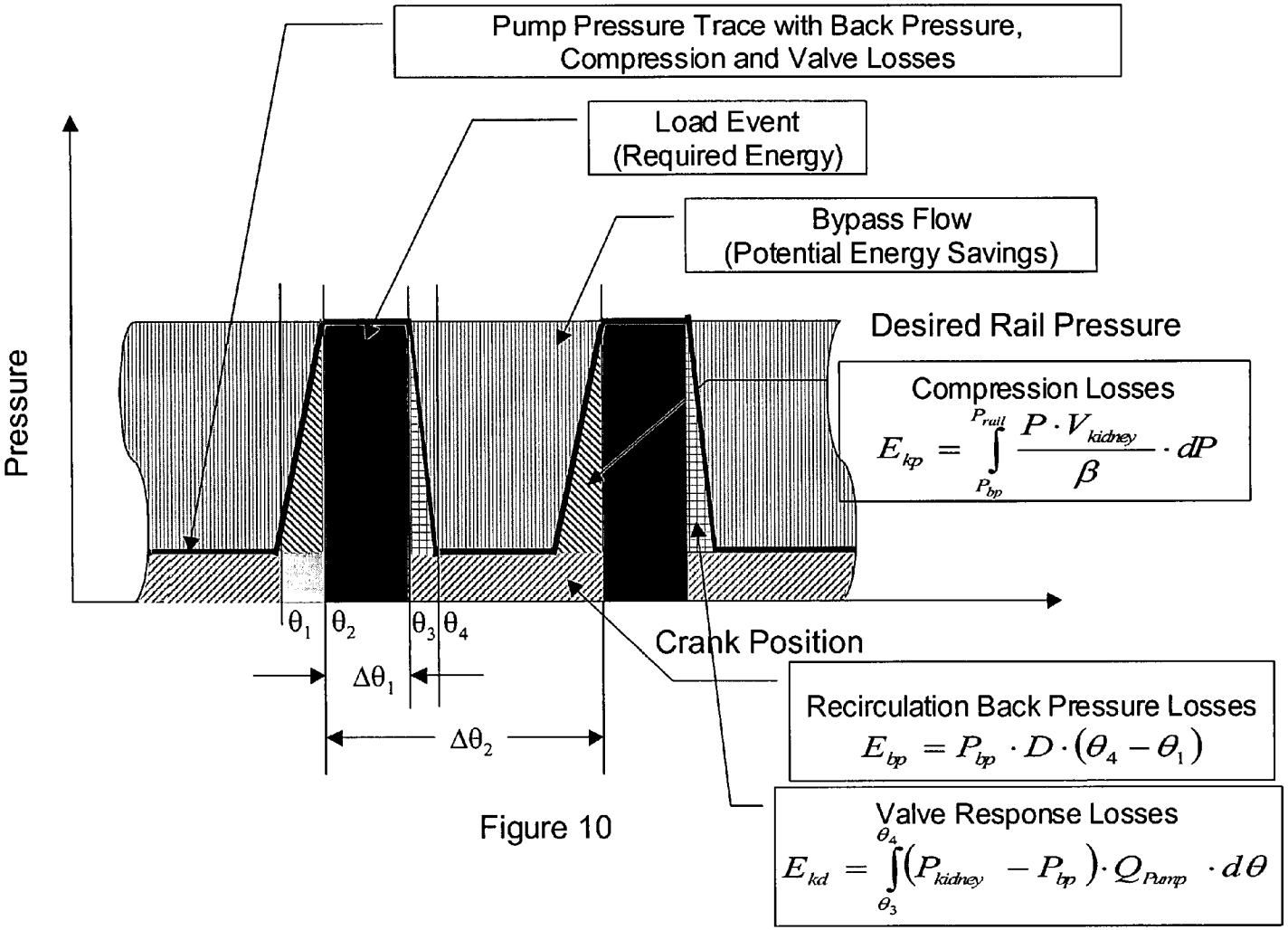
FIG. 10 illustrates the additional energy lost due to the time required for the bypass valve to fully open.

With the present invention there will be a backpressure loss across the pump control valve and porting from the pump outlet to the pump inlet while the pump is in bypass, and accordingly, the total savings will be less than suggested by FIG. 7, as illustrated in FIG. 8. Further, assuming the pressure in the high pressure rail is substantial, and thus the compressibility of the hydraulic fluid must be taken into account, pumping energy will be absorbed in the compression of the hydraulic fluid in the output side of the pump so that the energy savings will be further reduced as illustrated in FIG. 9. Finally, energy will be lost because the pump outlet pressure is elevated while the bypass valve is opening, as illustrated in FIG. 10. Still, even with these losses, there is a large potential for energy savings that not only increases fuel efficiency of the engine, but in fact leaves more shaft horsepower output for an engine of a given size. A similar analysis may be done for systems that do not maintain full rail pressure during a load event.

Figure 3A:
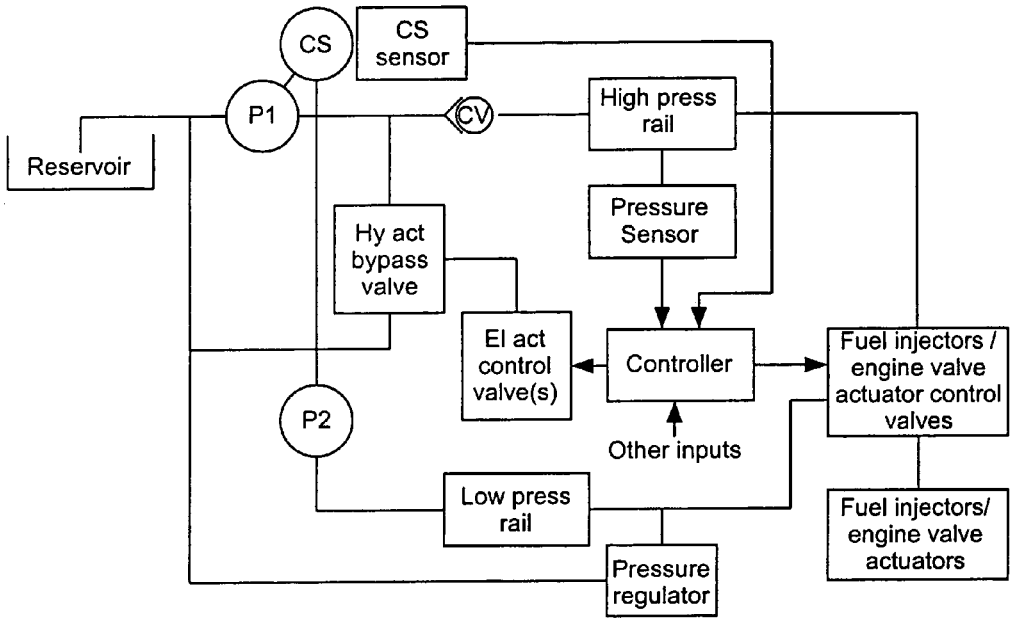
FIG. 3*a* is a diagram of an alternate embodiment of the present invention using a check valve.
Figure 3B:
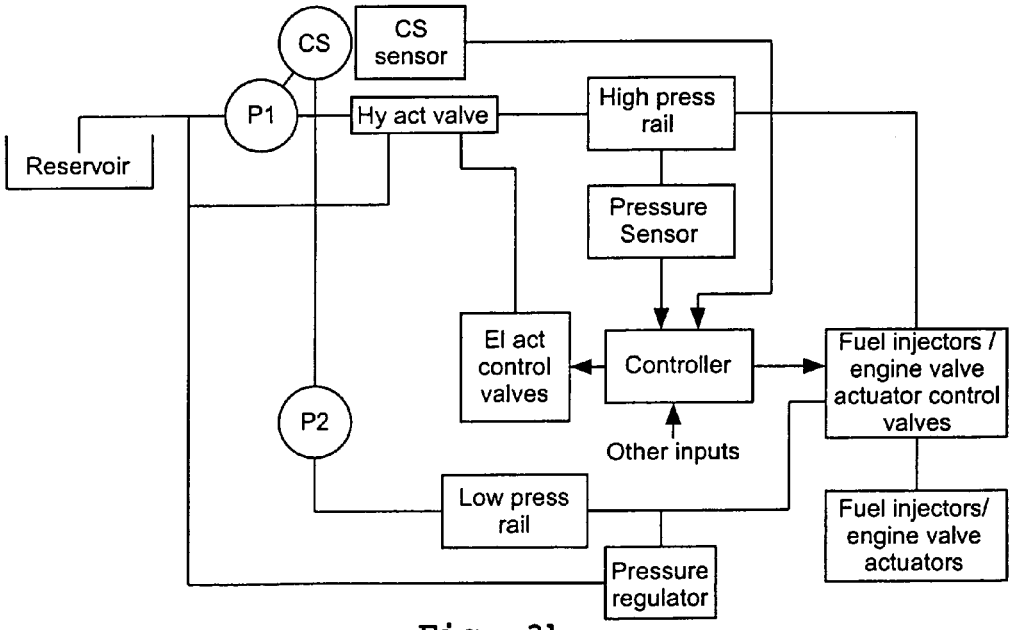
FIG. 3*b* is a diagram of an alternate embodiment of the present invention using a three-way valve.

In an embodiment like that of FIGS. 2*a* and 2*b*, the desired size, cost and performance of the electrically actuated valves may be difficult to achieve. Accordingly, an alternate embodiment is shown in FIG. 3*a*. In this embodiment, the pressure of the high pressure rail is controlled in substantially the same manner as in the embodiment of FIGS. 2*a* and 2*b*, though instead of using an electrically actuated control valve to directly control the bypass fluid, a two-stage bypass system is used wherein one or more electrically actuated control valves controlled by the controller actually control a hydraulically actuated bypass valve. Various variations of such two-stage controls are shown in U.S. Patent Application Publication No. U.S. 2003/0015155A1, previously incorporated herein by reference, and accordingly, need not be described in detail herein. Because the hydraulically actuated bypass valve is preferably controlled by a hydraulic fluid from a lower pressure rail, the system of FIG. 3*a* utilizes a second pump P2 to supply the low pressure rail. This low pressure is also used for a two-stage HVA system control as disclosed in that Patent Application Publication, and accordingly, the low pressure rail is also shown as connected to the fuel injector/engine valve actuator control valve. Finally, since the pressure in the low pressure rail is normally fairly low in comparison to the high pressure rail, if the second pump P2 is a fixed displacement pump, a pressure regulator might be used to bleed any excess flow of low pressure fluid from pump P2 to the reservoir without wasting large amounts of energy. In FIG. 3*b*, the check valve and the hydraulically actuated valve have been replaced by a different kind of hydraulically actuated valve, though operation remains substantially the same.

As a further alternative, second pump P2, being a lower pressure pump, might be a variable displacement pump if desired, thereby eliminating these losses. Still further alternatively, a single pump P1 may be used in embodiments like that of FIGS. 3*a* and 3*b* where the hydraulically actuated valves do not return the excess flow from the high pressure pump P1 outlet to the pump inlet, but rather provide the same to the low pressure rail, with a pressure regulator bleeding any further excess flow back to the pump input. Thus the second pump of FIGS. 3*a* and 3*b* is eliminated. In a system in accordance with FIGS. 4*a* and 4*b*, a single high pressure pump P1 may not supply fluid to both the high pressure rail and the low pressure rail at the same time, though if during a load event both high pressure fluid and low pressure fluid are being used, the controller can select which rail to add fluid to, and if the combination of the compressibility of the fluid and size of the rail will not adequately maintain rail pressure during a load event, one or both rails may incorporate a hydraulic accumulator (as can any of the other embodiments), as is known in the art.

Figure 4A:
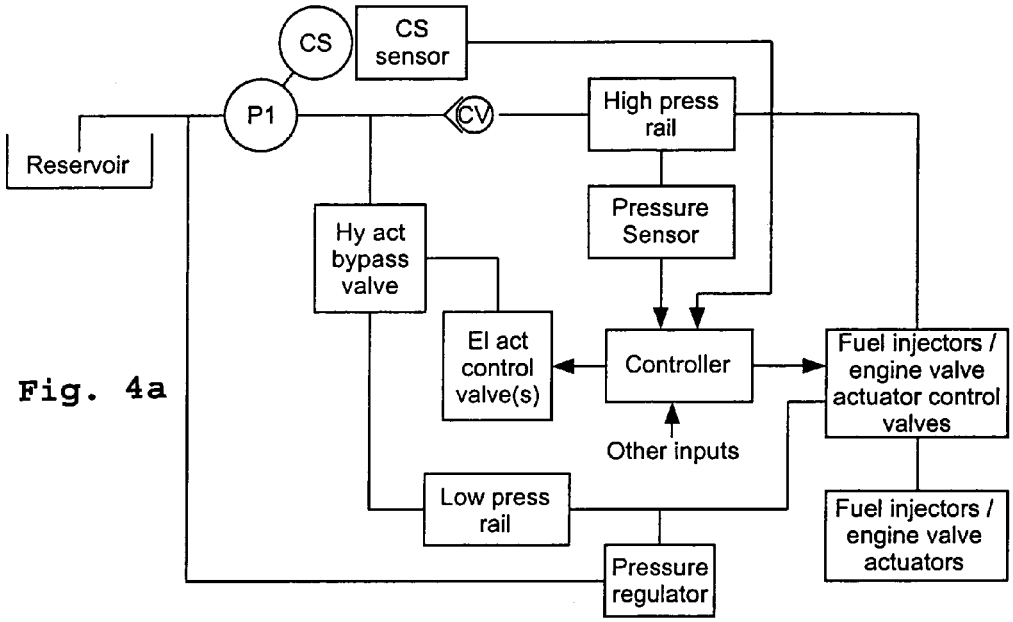
FIGS. 4*a* and 4*b* are embodiments using the same pump and a pressure regulator to supply both a high pressure rail and a low pressure rail.
Figure 4B:
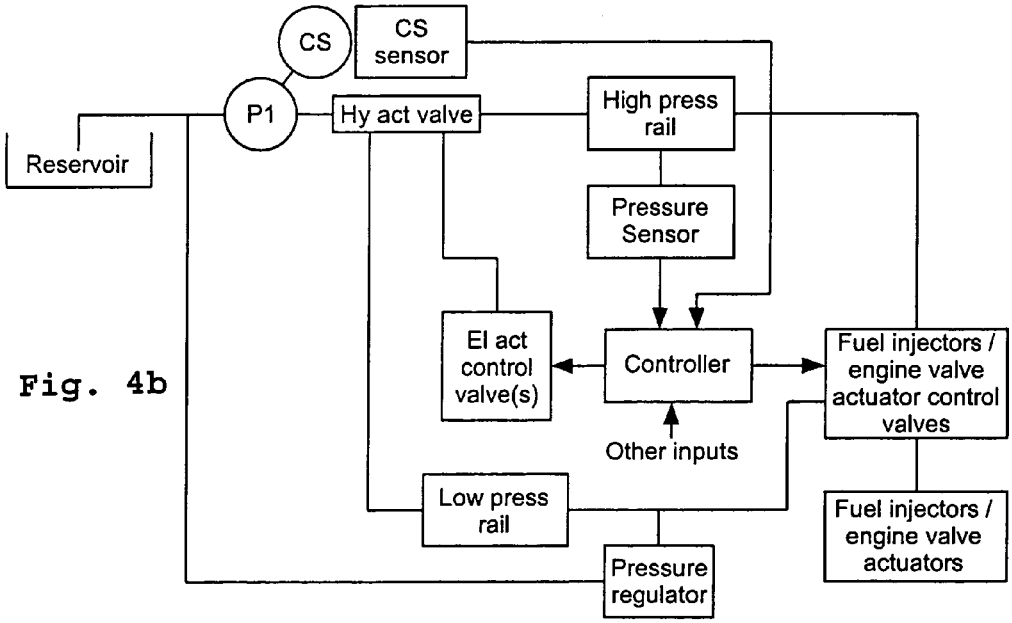
Figure 5:
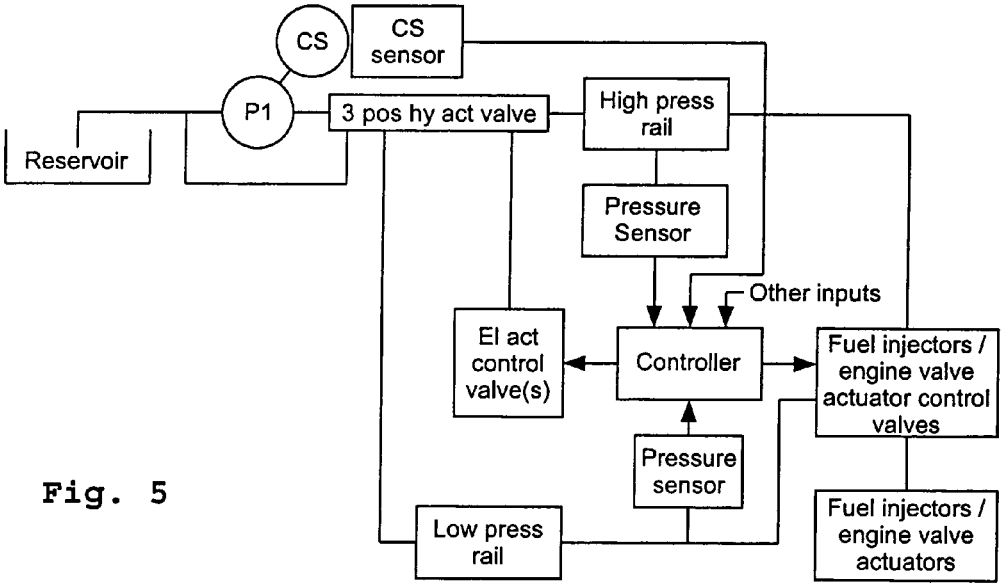
FIG. 5 is an embodiment using the same pump and a three-position valve to supply both a high pressure rail and a low pressure rail.

Finally, referring to FIG. 5, an embodiment similar to that of FIGS. 4*a* and 4*b*, though using a three position hydraulically actuated valve to cause the high pressure pump P1 to deliver hydraulic fluid to the high pressure rail when at one travel limit, to deliver excess flow not required by the high pressure rail to the low pressure rail when spring biased or otherwise moved to a mid position, and further, to direct excess fluid not required by either the high pressure rail or the low pressure rail back to the pump input when in the second travel limit, may be seen. Thus in this embodiment a single pump is used, though even most of the losses through the pressure regulator of FIGS. 4*a* and 4*b* are avoided in the embodiment of FIG. 5. This concept could be expanded to more than three position valves supplying additional rails.

Figure 11:
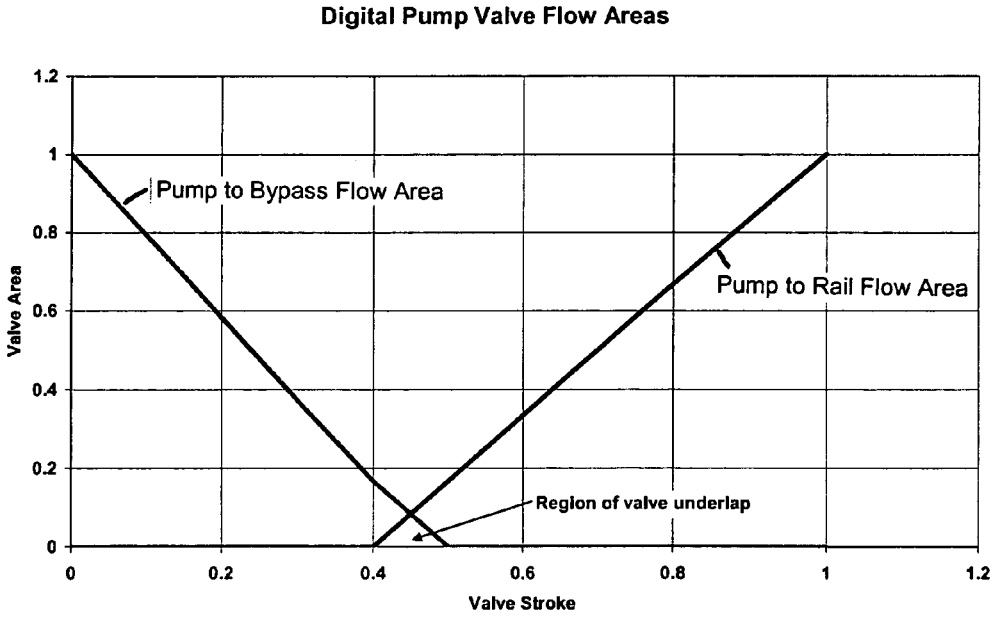
FIG. 11 illustrates the underlap of a three-way valve used in embodiments of the present invention.

Also in the embodiment of FIG. 5 and other embodiments not depending on the check valve CV for pressure relief, assuming pump P1 is a fixed displacement pump, the valve switching pump outlet fluid flow should be an open before close variety on each flow switching transition to avoid a momentary flow blockage. As used herein, valve underlap is defined for the digital pump application as when simultaneously, there is a flow area from the pump to the rail and a flow area from the pump to the flow bypass (either the pump inlet or low pressure rail). The concept is not limited to using a spool valve for digital pump control; however, the discussion that follows will use a spool valve for concept illustration. Graphically, the concept of valve underlap for a spool valve is shown in FIG. 11. Optimizing this flow area schedule is essential to pump performance and pump efficiency. If there is no valve underlap, the pump will deadhead during the switching from rail supply to bypass and back. Deadheading the pump creates a large pressure spike in the pump kidney, causing both noise and possible structural issues. In the case of a spool valve, this also leads to longer valve strokes to get the same final flow area and thus more switching time, which in turn lowers the efficiency of the digital pump. If the underlap region is too large however, there is a substantial amount of flow from the rail to the bypass during the switching operation (referred to as short-circuit flow). This loss of fluid from the rail reduces the overall efficiency of the digital pump. The optimization of the underlap should eliminate the deadhead, minimize short-circuit flow and reduce the valve stroke and valve switching time. The idea is to get good pump performance at the best overall pump efficiency. While the ideal underlap will be somewhat engine (pump) speed dependent, and viscosity and thus fluid temperature dependent, these effects are secondary effects. Various techniques may be used to establish the best underlap to be used. By way of example, valves with different underlaps may be tested and the results plotted to allow selection of the underlap that is the best compromise throughout the engine operating range. Note that if desired, other valving arrangements may be used, such as two two-way valves, so that the underlap may be varied based on varying conditions, though a fixed compromise underlap should operate satisfactorily throughout varying conditions.

Figure 12:
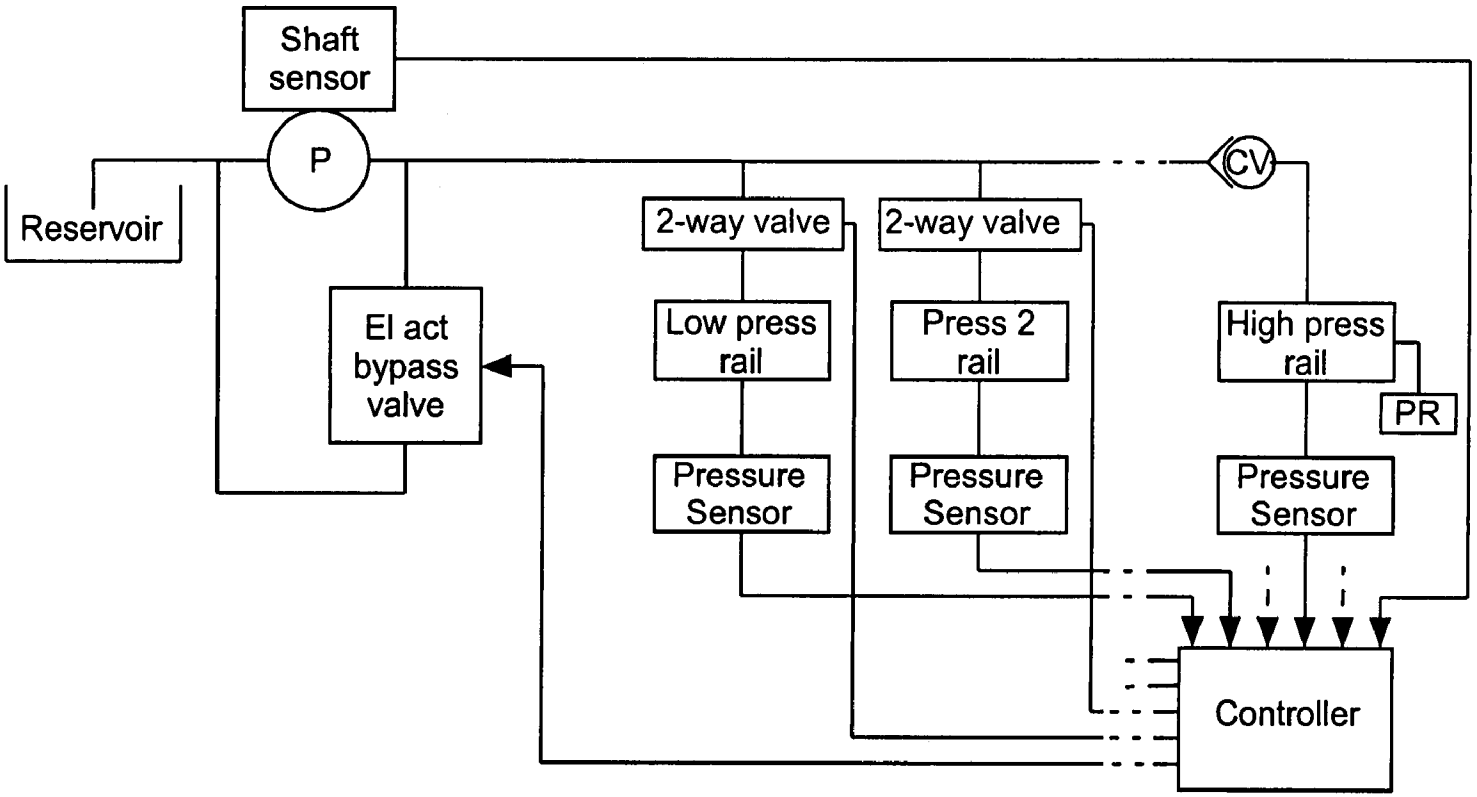
FIG. 12 is a block diagram of a pumping system for maintaining different pressures in multiple rails using a single pump.

Now referring to FIG. 12, a more generalized pumping system in accordance with the present invention may be seen. As shown therein, a pump P, preferably a positive displacement pump though not necessarily so, delivers hydraulic fluid to the pump outlet. Whenever the electrically actuated bypass valve is open, the output of the pump P is merely delivered to its input. However, when the electrically actuated bypass valve is closed, one of the two-way valves shown may be opened by the controller to deliver the pump output to the associated rail, the controller shutting off the two-way valve when the associated pressure sensor indicates that the desired pressure has been attained. As shown therein, the pressure in any number of rails may be controlled in this manner from a single pump. If the electrically actuated bypass valve and all of the two-way valves are closed, the pump output is delivered through the check valve CV to the high pressure rail. The check valve CV also provides a failsafe flow path in the event both the electrically actuated bypass valve and all of the two-way valves are momentarily closed at the same time during any transition period. In some applications, one can be assured that the demand for fluid from the high pressure rail will be sufficient to limit the pressure in the high pressure rail, though in other applications where the demand for high pressure fluid is not dependable, a pressure relief PR may be provided to prevent the pressure in the high pressure rail from creeping up to an excessive level.

Also shown in FIG. 12 is a shaft sensor providing an input to the controller. This is optional, in that in many applications requiring hydraulic fluid at multiple rail pressures, the demand for the hydraulic fluid from each rail is relatively random and not synchronized to the pump shaft angle or an engine crankshaft angle. In other applications, such as in engine applications as hereinbefore described, fluid demand from the various rails may be synchronized or referenced to crankshaft angle, such as for fuel injectors and hydraulic engine valve actuators. While this embodiment is useful in such applications, such hydraulically actuated components are not shown in the Figure to avoid overly complicating the Figure.

While certain preferred embodiments of the present invention have been disclosed and described herein, it will be understood by those skilled in the art that various changes in form and detail may be made therein without departing from the spirit and scope of the invention. Similarly, the various aspects of the present invention may be advantageously practiced by incorporating all features or various sub-combinations of features.

What is claimed is:

1. A pump system for use in engines having hydraulically actuated elements requiring fluid under pressure from a high pressure rail on each actuation load event, the load events being referenced to the engine crankshaft angle, comprising:

a pump;

a high pressure rail;

a pressure sensor coupled to sense the pressure in the high pressure rail;

a valve coupled to controllably cause an output of the pump to pass to the high pressure rail or to return to a pump input;

a crankshaft angle sensor; and, a controller coupled to the pressure sensor, the valve and the crankshaft angle sensor, the controller controlling the valve after a load event to cause an output of the pump to return to a pump input;

the controller also being responsive to the pressure sensor and the crankshaft angle sensor to control the valve to cause an output of the pump to pass to the high pressure rail starting at a crankshaft angle preceding the crankshaft angle of a coming load event by an amount dependent on the existing rail pressure and a first desired pressure at the beginning of the load event.

2. The system of claim 1 wherein the controller controls the valve after a load event to cause an output of the pump to return to the pump input when the pressure in the high pressure rail reaches a second desired pressure different than the first desired pressure.

3. The system of claim 1 wherein the valve coupled to controllably cause the output of the pump to pass to the high pressure rail or to return to the pump input comprises a valve having a moving member causing the output of the pump to pass to the high pressure rail when the moving member is in a first position and causing the pump output to return to the pump input when the moving member is in a second position, the moving member causing the output of the pump to partially pass to the high pressure rail and to partially return to the pump input when the moving member is in a position between the first and second positions.

4. The system of claim 3 wherein the valve is a two stage valve, the first stage being an electromagnetically actuated spool valve and the second stage being a hydraulically controlled spool valve, the first stage controlling the second stage responsive to a control signal provided to the first stage.

5. The system of claim 1 wherein the valve is a two stage valve, the first stage being an electromagnetically actuated spool valve and the second stage being a hydraulically controlled spool valve, the first stage controlling the second stage responsive to a control signal provided to the first stage.

6. The system of claim 1 wherein the valve comprises a check valve between the pump output and the high pressure rail and a two way valve between the pump output and the pump input.

7. The system of claim 1 wherein the valve is a three way valve.

8. A pump system for use in engines having hydraulically actuated elements requiring fluid under pressure from a high pressure rail on each actuation load event, the load events being referenced to the engine crankshaft angle, comprising:

a pump;

a high pressure rail;

a first pressure sensor coupled to sense the pressure in the high pressure rail;

valving coupled to controllably cause an output of the pump to pass to the high pressure rail or to a lower pressure region;

a crankshaft angle sensor; and, a controller coupled to the first pressure sensor, the valving and the crankshaft angle sensor, the controller controlling the valving after a load event to cause an output of the pump to pass to the lower pressure region;

the controller also being responsive to the first pressure sensor and the crankshaft angle sensor to control the valving to cause an output of the pump to pass to the high pressure rail starting at a crankshaft angle preceding the crankshaft angle of a coming load event by an amount dependent on the existing rail pressure and a first desired pressure at the beginning of the load event.

9. The system of claim 8 wherein the lower pressure region is coupled to an input of the pump.

10. The system of claim 8 wherein the lower pressure region is a lower pressure rail, the lower pressure rail also being coupled to the pump input through a pressure regulator regulating the pressure in the lower pressure rail.

11. The system of claim 8 wherein the lower pressure region is a lower pressure rail, and further comprising a second pressure sensor coupled to the lower pressure rail, the valving also being coupled to controllably cause an output of the pump to pass to an input of the lower pressure rail, the controller also being coupled to the second pressure sensor to cause an output of the pump to pass to the high pressure rail starting at a crankshaft angle preceding the crankshaft angle of a coming load event by an amount dependent on the existing rail pressure and a first desired pressure at the beginning of the load event, to pass to the lower pressure rail after a load event, and to pass to the pump input when the second pressure sensor senses the presence of a second desired pressure in the lower pressure rail.

12. The system of claim 11 wherein the valving comprises a check valve between the pump output and the high pressure rail, a two way valve between the pump output and the lower pressure rail, and a two way valve between the pump output and the pump input.

13. The system of claim 11 wherein the valving comprises a three position valve.

14. The system of claim 11 wherein the controller controls the valving after a load event to cause an output of the pump to pass to the lower pressure rail or to the pump input when the pressure in the high pressure rail reaches a second desired pressure different than the first desired pressure.

15. The system of claim 8 wherein the valving comprises a check valve between the pump output and the high pressure rail and a two way valve between the pump output and the lower pressure region.

16. The system of claim 8 wherein the valving comprises a three way valve.

17. The system of claim 8 wherein the controller controls the valving after a load event to cause an output of the pump to pass to the lower pressure region when the pressure in the high pressure rail reaches a second desired pressure different than the first desired pressure.

* * * * *